US009570067B2

(12) United States Patent
Yamasaki et al.

(10) Patent No.: US 9,570,067 B2
(45) Date of Patent: Feb. 14, 2017

(54) TEXT-TO-SPEECH SYSTEM, TEXT-TO-SPEECH METHOD, AND COMPUTER PROGRAM PRODUCT FOR SYNTHESIS MODIFICATION BASED UPON PECULIAR EXPRESSIONS

(71) Applicant: KABUSHIKI KAISHA TOSHIBA, Minato-ku, Tokyo (JP)

(72) Inventors: Tomohiro Yamasaki, Tokyo (JP); Yuji Shimizu, Kanagawa (JP); Noriko Yamanaka, Kanagawa (JP); Makoto Yajima, Tokyo (JP); Yuichi Miyamura, Kanagawa (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 0 days.

(21) Appl. No.: 14/644,389

(22) Filed: Mar. 11, 2015

(65) Prior Publication Data

US 2015/0269927 A1 Sep. 24, 2015

(30) Foreign Application Priority Data

Mar. 19, 2014 (JP) ..... 2014-056667

(51) Int. Cl.
*G10L 13/08* (2013.01)
*G10L 13/10* (2013.01)

(52) U.S. Cl.
CPC ..... *G10L 13/08* (2013.01); *G10L 13/10* (2013.01); *G10L 2013/083* (2013.01)

(58) Field of Classification Search
CPC .... G10L 13/08; G10L 2013/083; G10L 13/10; G10L 2013/105

(Continued)

(56) References Cited

U.S. PATENT DOCUMENTS 6,032,111 A * 2/2000 Mohri ..... G06F 17/2755 704/257
6,064,383 A * 5/2000 Skelly ..... G06T 11/00 715/758

(Continued)

FOREIGN PATENT DOCUMENTS

JP 2006-017819 1/2006
JP 2006-235916 9/2006

(Continued)

OTHER PUBLICATIONS

Baldwin, et al. "Beyond Normalization: Pragmatics of Word Form in Text Messages." IJCNLP 2011, Nov. 2011, pp. 1437-1441.*

(Continued)

*Primary Examiner* — James Wozniak
(74) *Attorney, Agent, or Firm* — Amin, Turocy & Watson LLP

(57) ABSTRACT

According to an embodiment, a text-to-speech device includes a receiver to receive an input text containing a peculiar expression; a normalizer to normalize the input text based on a normalization rule in which the peculiar expression, a normal expression of the peculiar expression, and an expression style of the peculiar expression are associated, to generate normalized texts; a selector to perform language processing of each normalized text, and select a normalized text based on result of the language processing; a generator generate a series of phonetic parameters representing phonetic expression of the selected normalized text; a modifier modifies a phonetic parameter in the normalized text corresponding to the peculiar expression in the input text based on a phonetic parameter modification method according to the normalization rule of the peculiar expression; and a output unit to output a phonetic sound synthesized using the series (Continued)

of phonetic parameters including the modified phonetic parameter.

9 Claims, 10 Drawing Sheets

(58) Field of Classification Search
USPC ..... 704/258, 260, 9
See application file for complete search history.

(56) References Cited

U.S. PATENT DOCUMENTS 7,987,093 B2 7/2011 Noda
8,688,435 B2 * 4/2014 Nasri ..... G06F 17/2229 704/254
8,856,236 B2 * 10/2014 Moore ..... G10L 15/265 379/88.14
2005/0119890 A1 * 6/2005 Hirose ..... G10L 13/08 704/260
2006/0224385 A1 * 10/2006 Seppala ..... G10L 13/08 704/260
2007/0027673 A1 * 2/2007 Moberg ..... G10L 13/08 704/9
2007/0143410 A1 * 6/2007 Kraft ..... G06Q 10/107 709/206
2007/0239837 A1 * 10/2007 Jablokov ..... G06Q 30/0251 709/206
2008/0235024 A1 * 9/2008 Goldberg ..... G10L 13/033 704/260
2008/0262846 A1 * 10/2008 Burns ..... H04L 12/5895 704/260
2010/0082348 A1 * 4/2010 Silverman ..... G10L 13/08 704/260
2011/0010178 A1 * 1/2011 Lee ..... G06F 17/2223 704/260
2011/0173001 A1 * 7/2011 Guy, III ..... G06F 17/2276 704/246
2012/0078633 A1 3/2012 Fume et al.
2012/0143611 A1 * 6/2012 Qian ..... G10L 13/07 704/260
2012/0215532 A1 * 8/2012 Foo ..... H04R 25/505 704/235
2013/0096911 A1 * 4/2013 Beaufort ..... G06F 17/273 704/9
2013/0218568 A1 * 8/2013 Tamura ..... G10L 13/033 704/260
2014/0200894 A1 * 7/2014 Osowski ..... G10L 13/08 704/260
2014/0222415 A1 * 8/2014 Legat ..... G10L 13/08 704/8

FOREIGN PATENT DOCUMENTS

JP 2007-334144 12/2007
JP 2012-073519 4/2012
JP 4930584 5/2012

OTHER PUBLICATIONS

ElAarag, et al. "A speech recognition and synthesis tool." Proceedings of the 44th annual Southeast regional conference. ACM, Mar. 2006, pp. 45-49.*

* cited by examiner

FIG.2

| | TEXT CONTAINING PECULIAR EXPRESSIONS | | TEXT NOT CONTAINING PECULIAR EXPRESSIONS |
|---|---|---|---|
| 1 | ぁたしわ | ↔ | あたしは |
| 2 | 糸冬 | ↔ | 終 |
| 3 | レハ | ↔ | い |
| 4 | や゛〜め゛〜で゛〜 | ↔ | やーめーてー |
| 5 | いや゛だ〜 | ↔ | いやだー |
| 6 | 山ー田! | ↔ | 山田! |

101

FIG.3

201

| PECULIAR EXPRESSION | NORMAL EXPRESSION | NON-LINGUISTIC MEANING | FIRST COST |
|---|---|---|---|
| 〜 | - | TO STRETCH THE VOICE IN A TREMULOUS TONE | 1 |
| THREE OF MORE “あ” IN SUCCESSION | あ | TO LET LOOSE SCREAM | 2 |
| THREE OF MORE “o” IN SUCCESSION | oo OR o | TO LET LOOSE SCREAM | 2 |
| THREE OF MORE “e” IN SUCCESSION | ee OR e | TO LET LOOSE SCREAM | 2 |
| あ゛ | あ | TO MUDDY VOICE | 5 |
| ぢゃ | だ | TO SOUND LIKE OLD PERSON | 3 |
| にゃ | な | TO SOUND LIKE CAT | 3 |
| ゎ | わ | TO SOUND CUTE AND CHARGED UP | 5 |
| … | … | … | … |

101

102

202

FIG.4

| PECULIAR EXPRESSION | CONDITIONAL EXPRESSION |
|---|---|
| *" | *"→* |

103 203

FIG.5

| PECULIAR EXPRESSION | NORMAL EXPRESSION | |
|---|---|---|
| にゃ゛ | にゃ | 204 |
| | な゛ | 304 |
| | な | 404 |

104

FIG.6

5 205 305

| INPUT TEXT | いや゛だ～ | MORPHEME STRING | SECOND COST |
|---|---|---|---|
| NORMALIZED-TEXT LIST | いやだ～ | いや (ADJECTIVE)/ だ (AUXILIARY VERB)/ ～ (SYMBOL) | 6 |
| | いや゛た～ | い (VERB)/ や゛( (UNKNOWN WORD)/ た (AUXILIARY VERB)/ ～ (SYMBOL) | 21 |
| | いや゛だー | い (VERB)/ や゛ (UNKNOWN WORD)/ だー (AUXILIARY VERB) | 16 |
| | いやた～ | いや (ADJECTIVE)/ た (AUXILIARY VERB)/ ～ (SYMBOL) | 8 |
| | いやだー | いや (ADJECTIVE)/ だー (AUXILIARY VERB) | 1 |
| | いや゛たー | い (VERB)/ や゛ (UNKNOWN WORD)/ たー (AUXILIARY VERB) | 16 |
| | いやたー | いや (ADJECTIVE)/ たー (AUXILIARY VERB) | 3 |

206 306

FIG.11

| LOWER-CASE CHARACTERS AS UNKNOWN WORDS | | | |
|---|---|---|---|
| や | ゆ | よ | わ |
| 109 | 110 | 111 | 112 |

FIG.12

| EXPRESSION STYLE | MODIFICATION METHOD |
|---|---|
| TO STRETCH VOICE IN TREMULOUS TONE | INCREASE AND DECREASE VOLUME IN PERIODIC MANNER<br>RAISE AND LOWER PITCH IN PERIODIC MANNER |
| TO LET LOOSE SCREAM | KEEP VOLUME HIGH FOR LONG DURATION OF TIME<br>SUBSTITUTE SYNTHESIS UNIT REPRESENTING FEELING OF ANGER |
| TO MUDDY VOICE | SUBSTITUTE SYNTHESIS UNIT PRONOUNCED BY STRAINING OF GLOTTIS<br>SUBSTITUTE SYNTHESIS UNIT REPRESENTING FEMALE VOICE WITH SYNTHESIS UNIT REPRESENTING MALE VOICE<br>APPLY, OTHER WAY ROUND, DIFFERENCE BETWEEN PHONETIC PARAMETERS OF PHONEMES HAVING DISTINCTION BETWEEN VOICED SOUND AND UNVOICED SOUND |
| TO SOUND LIKE OLD PERSON | (WHEN READING AGE IS VARIABLE) TO INCREASE QUALIFYING AGE<br>SUBSTITUTE SYNTHESIS UNIT REPRESENTING YOUNG PERSON WITH SYNTHESIS UNIT REPRESENTING OLD PERSON<br>DECREASE FUNDAMENTAL FREQUENCY OF SYNTHESIS UNIT |
| TO SOUND LIKE CAT | SUBSTITUTE CRY OF CAT |
| TO SOUND CUTE AND CHARGED UP | TO INCREASE VOICE INTONATION<br>(WHEN READING AGE IS VARIABLE) TO DECREASE QUALIFYING AGE<br>SUBSTITUTE SYNTHESIS UNIT REPRESENTING MALE VOICE WITH SYNTHESIS UNIT REPRESENTING FEMALE VOICE<br>INCREASE FUNDAMENTAL FREQUENCY OF SYNTHESIS UNIT |
| ... | ... |

TEXT-TO-SPEECH SYSTEM, TEXT-TO-SPEECH METHOD, AND COMPUTER PROGRAM PRODUCT FOR SYNTHESIS MODIFICATION BASED UPON PECULIAR EXPRESSIONS

CROSS-REFERENCE TO RELATED APPLICATIONS

This application is based upon and claims the benefit of priority from Japanese Patent Application No. 2014-056667, filed on Mar. 19, 2014; the entire contents of which are incorporated herein by reference.

FIELD

Embodiments described herein relate generally to a text-to-speech device, a text-to-speech method, and a computer program product.

BACKGROUND

In recent years, reading out documents using speech synthesis (TTS: Text To Speech) is getting a lot of attention. Although reading out books has been carried out in the past too; the use of TTS results in making narration recording redundant, thereby making it easier to enjoy the recitation voice. Moreover, regarding blogs or Twitter (registered trademark) in which the written text is updated almost in real time, TTS-based services are being provided these days. As a result of using a TTS-based service, reading of a text can be listened to while doing some other task.

However, when users write texts in a blog or Twitter, some of the users use leet-speak expressions (hereinafter, called "peculiar expressions") that are not found in normal expressions. The person who sends such a text is intentionally expressing some kind of mood using peculiar expressions. However, since peculiar expressions are totally different than the expressions in a normal text, the conventional text-to-speech devices are not able to correctly analyze the text containing peculiar expressions. For that reason, if a conventional text-to-speech device performs speech synthesis of a text containing peculiar expressions; not only it is not possible to reproduce the mood that the sender wished to express, but the reading also turns out to be completely irrational.

BRIEF DESCRIPTION OF THE DRAWINGS

FIG. 2 is a diagram illustrating an exemplary text containing peculiar expressions;

FIG. 3 is a diagram illustrating an example of normalization rules according to the embodiment;

FIG. 4 is a diagram illustrating a modification example of a normalization rule (in the case of using a conditional expression) according to the embodiment;

FIG. 5 is a diagram illustrating an example in which a plurality of normalization rules is applicable at the same position in a text;

FIG. 6 is a diagram illustrating an exemplary normalized-text list according to the embodiment;

FIG. 11 is a diagram illustrating examples of lower-case characters as unknown words;

FIG. 12 is a diagram illustrating exemplary phonetic parameter modification methods according to the embodiment;

DETAILED DESCRIPTION

According to an embodiment, a text-to-speech device includes a receiver, a normalizer, a selector, a generator, a modifier, and an output unit. The receiver receives an input text which contains a peculiar expression. The normalizer normalizes the input text based on a normalization rule in which the peculiar expression, a normal expression for expressing the peculiar expression in a normal form, and an expression style of the peculiar expression are associated with one another, so as to generate one or more normalized texts. The selector performs language processing with respect to each of the normalized texts, and selects a single normalized text based on result of the language processing. The generator generates a series of phonetic parameters representing phonetic expression of the single normalized text. The modifier modifies a phonetic parameter in the normalized text corresponding to the peculiar expression in the input text based on a phonetic parameter modification method according to the normalization rule of the peculiar expression. The output unit outputs a phonetic sound which is synthesized using the series of phonetic parameters including the modified phonetic parameter.

Figure 1:
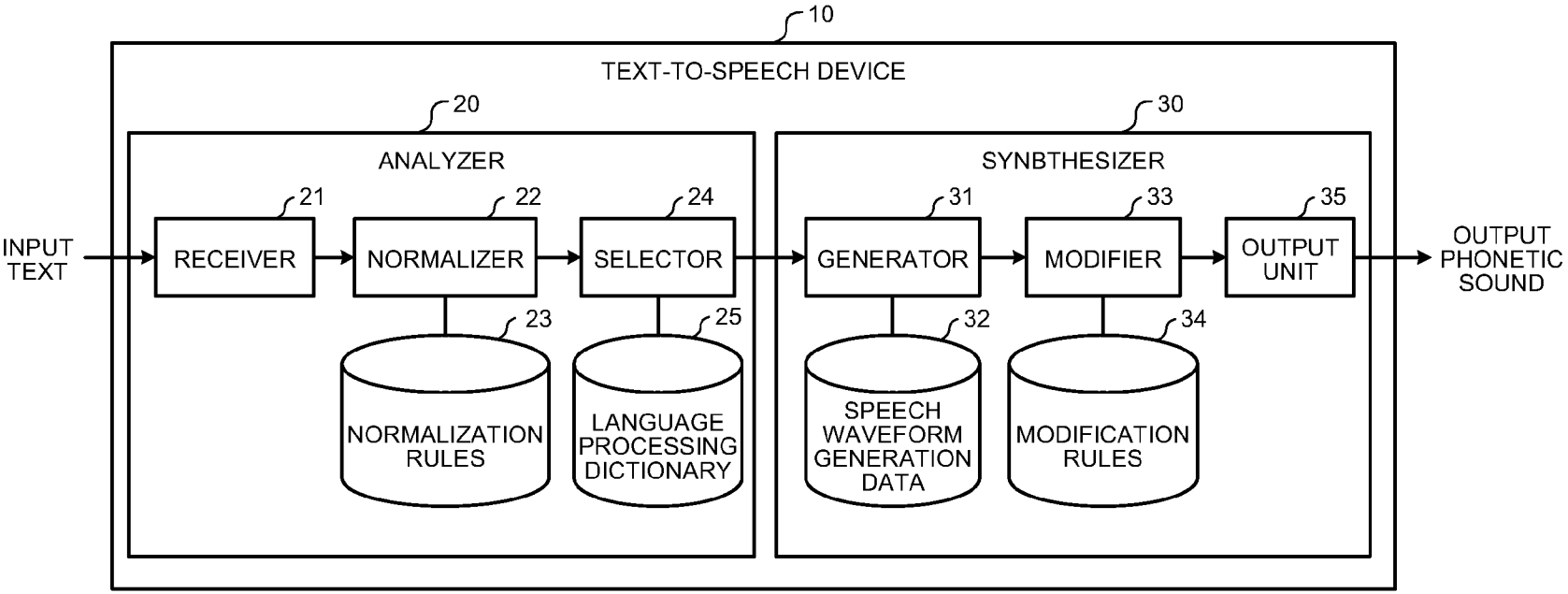
FIG. 1 is a diagram illustrating an exemplary configuration of a text-to-speech device according to an embodiment.

An embodiment will be described below in detail with reference to the accompanying drawings. FIG. 1 is a diagram illustrating an exemplary configuration of a text-to-speech device 10 according to the embodiment. The text-to-speech device 10 receives a text; performs language processing with respect to the text; and reads out the text using speech synthesis based on the result of language processing. According to the embodiment, the text-to-speech device 10 includes an analyzer 20 and a synthesizer 30.

The analyzer 20 performs language processing with respect to the text received by the text-to-speech device 10. The analyzer 20 includes a receiver 21, a normalizer 22, normalization rules 23, a selector 24, and a language processing dictionary 25.

The synthesizer 30 generates a speech waveform based on the result of language processing performed by the analyzer 20. The synthesizer 30 includes a generator 31, speech waveform generation data 32, a modifier 33, modification rules 34, and an output unit 35.

The normalization rules 23, the language processing dictionary 25, the speech waveform generation data 32, and the modification rules 34 are stored in a memory (not illustrated in FIG. 1).

Firstly, the explanation is given about the configuration of the analyzer 20. The receiver 21 receives input of a text containing peculiar expressions. Given below is the explanation of a specific example of a text containing peculiar expressions.

FIG. 2 is a diagram illustrating a text containing peculiar expressions. Herein, a text 1 represents an exemplary text containing a peculiar expression in which characters that are typically not written in lower-case character is written in lower-case character. Herein, for example, the text 1 is used to express jocular womanliness. Texts 2 and 3 represent exemplary texts in which a peculiar expression of combining the shapes of a plurality of characters is used to express a different character. The texts 2 and 3 produce the effect of, for example, bringing a character into prominence. Texts 4 and 5 represent exemplary texts containing peculiar expressions of attaching voiced sound marks to the characters that typically do not have the voiced sound marks attached thereto; and containing a peculiar expression 101 for expressing vibrato. The texts 4 and 5 express, for example, a sign of distress. A text 6 represents an exemplary text containing a peculiar expression of placing vibrato at a position at which vibrato is typically not placed. For example, the text 6 expresses the feeling of calling a person with a loud voice.

Meanwhile, the receiver 21 can also receive a text expressed in a language other than the Japanese language. In that case, for example, a peculiar expression can be "ooo" (three or more "o" in succession).

Returning to the explanation with reference to FIG. 1, the receiver 21 outputs the received text to the normalizer 22. That is, the normalizer 22 receives the text from the receiver 21. Then, based on normalization rules, the normalizer 22 generates a normalized-text list that contains one or more normalized texts. Herein, a normalized text represents data obtained by normalizing a text. That is, a normalized text represents data obtained by converting a text based on the normalization rules. Given below is the explanation about the normalization rules.

FIG. 3 is a diagram illustrating an example of the normalization rules according to the embodiment. Herein, a normalization rule represents information in which a peculiar expression, a normal expression, an expression style (a non-linguistic meaning), and a first cost are associated with one another. Herein, a peculiar expression represents an expression not used in normal expressions. A normal expression represents an expression in which a peculiar expression is expressed in a normal form. An expression style represents the manner in which a peculiar expression is read with a loud voice, and has a non-linguistic meaning.

A first cost represents a value counted in the case of applying a normalization rule. When a plurality of normalization rules is applicable to a text, an extremely high number of normalized texts are generated. Hence, when a plurality of normalization rules is applicable to a text, the normalizer 22 calculates the total first cost with respect to the text. That is, the normalizer 22 applies, to the text, the normalization rules only up to a predetermined first threshold value of the total first cost, thereby holding down the number of normalized texts that are generated.

In the example illustrated in FIG. 3, for example, a normal expression 201 represents the normal expression obtained by normalizing the peculiar expression 101. Moreover, the expression style of the peculiar expression 101 is "to stretch the voice in a tremulous tone". When the peculiar expression 101 is included in a text, the first cost of normalizing the peculiar expression 101 is "1". As another example, a normal expression 202 represents the normal expression obtained by normalizing a peculiar expression 102. Moreover, the expression style of the peculiar expression 102 is "to produce a cat-like voice". When the peculiar expression 102 is included in a text, the first cost of normalizing the peculiar expression 102 is "3".

Meanwhile, the peculiar expressions for applying normalization rules can be defined not only in units of character but also using regular expressions or conditional expressions. Moreover, the normal expressions can be defined not only as post-normalization data but also regular expressions or conditional expressions representing normalization.

FIG. 4 is a diagram illustrating a modification example of a normalization rule (in the case of using a conditional expression) according to the embodiment. A peculiar expression 103 represents an expression in which a voiced sound mark is attached to an arbitrary character that does not have a voiced sound mark attached thereto in a normal expression. A conditional expression 203 represents the normalization operation for normalizing the peculiar expression 103 into a normal expression, and indicates the operation of "removing the voiced sound mark from the original expression".

In the example illustrated in FIG. 3, a peculiar expression "three or more "o" in succession" and a peculiar expression "three or more "e" in succession" are exemplary peculiar expressions formed according to conditional expressions. The normal expression that is obtained by normalizing the peculiar expression "three or more "o" in succession" is either "oo" or "o". Moreover, the expression style of the peculiar expression "three or more "o" in succession" is "to let loose a scream". When the peculiar expression "three or more "o" in succession" is included in a text, the first cost of normalizing the peculiar expression "three or more "o" in succession" is "2". Similarly, the normal expression that is obtained by normalizing the peculiar expression "three or more "e" in succession" is either "ee" or "e". Moreover, the expression style of the peculiar expression "three or more "e" in succession" is "to let loose a scream". When the peculiar expression "three or more "e" in succession" is included in a text, the first cost of normalizing the peculiar expression "three or more "e" in succession" is "2". As a result of applying such normalization rules, the text-to-speech device 10 can recognize that, for example, the normal expression for "goooo toooo sleeeep!" is "go to sleep!"; and that the expression style of "goooo toooo sleeeep!" is "to let loose a scream".

Meanwhile, generally, there is a possibility that a plurality of normalization rules is applicable at the same position in a text. In such a case, either it is possible to apply any one of the normalization rules to the position, or it is possible to apply a plurality of normalization rules to the position at the time as long as the applied normalization rules do not contradict each other.

FIG. 5 is a diagram illustrating an example in which a plurality of normalization rules is applicable at the same position in a text. In the case in which the normalizer 22 applies the normalization rule of removing the voiced sound mark from a peculiar expression 104, a normal expression 204 is generated from the peculiar expression 104. Alternatively, in the case in which the normalizer 22 applies the normalization rule of generating the normal expression 202 from the peculiar expression 102 (see FIG. 3), a normal expression 304 is generated from the peculiar expression 104. Still alternatively, in the case in which the normalizer 22 applies both normalization rules at the same time, a normal expression 404 is generated from the peculiar expression 104.

Returning to the explanation with reference to FIG. 1, the normalizer 22 outputs, to the selector 24, a normalized-text list, which contains one or more normalized texts, and the expression styles of the peculiar expressions included in the input text. Then, the selector 24 performs language processing with respect to each normalized text using the language processing dictionary 25, and selects a single normalized text based on the result of language processing (based on morpheme strings (described later)). The language processing dictionary 25 is a dictionary in which words are defined in a corresponding manner to the information about the parts of speech of those words. Meanwhile, the selector 24 does not refer to the expression styles received from the normalizer 22, and outputs the expression styles along with the selected normalized text to the generator 31. Then, the generator 31 outputs the expression styles to the modifier 33. It is the modifier 33 that makes use of the expression styles. Given below is the concrete explanation about the method by which the selector 24 refers to an exemplary normalized-text list and selects a single normalized text from the normalized-text list.

Figure 7:
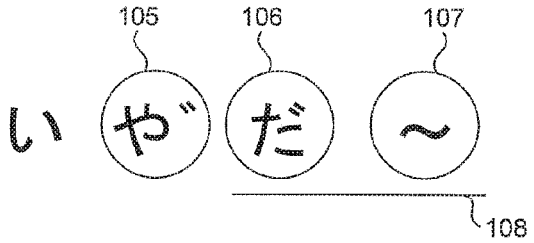
FIG. 7 is a diagram illustrating an example of a plurality of peculiar expressions included in a text.

FIG. 6 is a diagram illustrating an exemplary normalized-text list according to the embodiment. The example illustrated in FIG. 6 is of a normalized-text list created for the text 5 (see FIG. 2) that is input to the text-to-speech device 10. FIG. 7 is a diagram illustrating an example of a plurality of peculiar expressions included in the text 5. In the text 5, a single peculiar expression is included at the position of a peculiar expression 105, while two peculiar expressions are included at the position of a peculiar expression 108. Moreover, regarding a peculiar expression 106, the normal expression thereof also has a voiced sound mark attached thereto. However, because of the combination with a peculiar expression 107, the peculiar expression 106 is treated as a "peculiar expression". Accordingly, in all, the normalization rules are applicable at three positions. Moreover, in the case of applying the normalization rules, a total of seven combinations are applicable. Hence, the normalizer 22 generates a normalized-text list containing seven normalized texts.

Meanwhile, among normalized-text lists, a normalized-text list may be generated despite the fact that the expression is not actually a peculiar expression. Such a normalized-text list is generated because it fits into a conditional expression or because normalization rules get applied thereto. In that regard, with the aim of selecting the most plausible normalized text from the normalized-text list, the selector 24 calculates second costs. More particularly, the selector 24 performs language processing of a normalized text, and breaks the normalized text down into a morpheme string. Then, the selector 24 calculates a second cost according to the morpheme string.

In the example of the normalized-text list illustrated in FIG. 6, a normalized text 205 is broken down into a morpheme string 305. Herein, the morpheme string of the normalized text 205 includes an unknown word and a symbol. Hence, the selector 24 calculates the second cost of the normalized text 205 to be a large value (such as 21). Similarly, a normalized text 206 is broken down into a morpheme string 306. Since the morpheme string of the normalized text 206 does not include unknown words and symbols, the selector 24 calculates the second cost of the normalized text 206 to be a small value (such as 1). According to this method of calculating the second costs, the normalized texts that are likely to be linguistically inappropriate have large second costs. Consequently, the selector 24 selects the normalized text having the smallest second cost, thereby making it easier to select the most plausible normalized text from the normalized-text list. That is, the selector 24 selects a single normalized text from the normalized-text list according to the cost minimization method.

Meanwhile, generally, as the methods for obtaining a suitable morpheme string during language processing, various methods, such as the longest match principle and the clause count minimization method, are known aside from the cost minimization method. However, the selector 24 needs to select the most plausible normalized text from among the normalized texts generated by the normalizer 22. Hence, in the selector 24 according to the embodiment, the cost minimization method is implemented in which the costs of the morpheme strings (equivalent to the second costs according to the embodiment) are also obtained at the same time.

However, the method by which the selector 24 selects the normalized text is not limited to the cost minimization method. Alternatively, for example, from among the normalized texts having the second costs smaller than a predetermined second threshold value, it is possible to select the normalized text having the least number of times of text rewriting according to the normalization rules. Still alternatively, it is possible to select the normalized text having the smallest product of the (total) first cost, which is calculated during the generation of the normalized text, and the second cost, which is calculated from the morpheme string of the normalized text.

Returning to the explanation with reference to FIG. 1, the selector 24 reads the selected normalized text, and determines the prosodic type of that normalized text from the corresponding morpheme string. Then, the selector 24 outputs, to the generator 31, the selected normalized text, the phonetic expression of the selected normalized text, the prosodic type of the selected normalized text, and the expression styles at the positions in the selected normalized text that correspond to the peculiar expressions present in the input text.

The generator 31 makes use of the speech waveform generation data 32, and generates a series of phonetic parameters representing the phonetic expression of the normalized text selected by the selector 24. Herein, the speech waveform generation data 32 contains, for example, synthesis units or acoustic parameters. In the case of using synthesis units in generating the series of phonetic parameters; for example, synthesis unit IDs registered in a synthesis unit dictionary are used. In the case of using acoustic parameters in generating the series of phonetic parameters; for example, acoustic parameters based on the hidden Markov model (HMM) are used.

Regarding the generator 31 according to the embodiment, the explanation is given for an example in which synthesis units IDs registered in a synthesis unit dictionary are used as phonetic parameters. In the case of using HMM-based acoustic parameters, there are no single numerical values such as IDs. However, if combinations of numerical values are regarded as IDs, the HMM-based acoustic parameters can be essentially treated same as the synthesis unit IDs.

Figure 8:
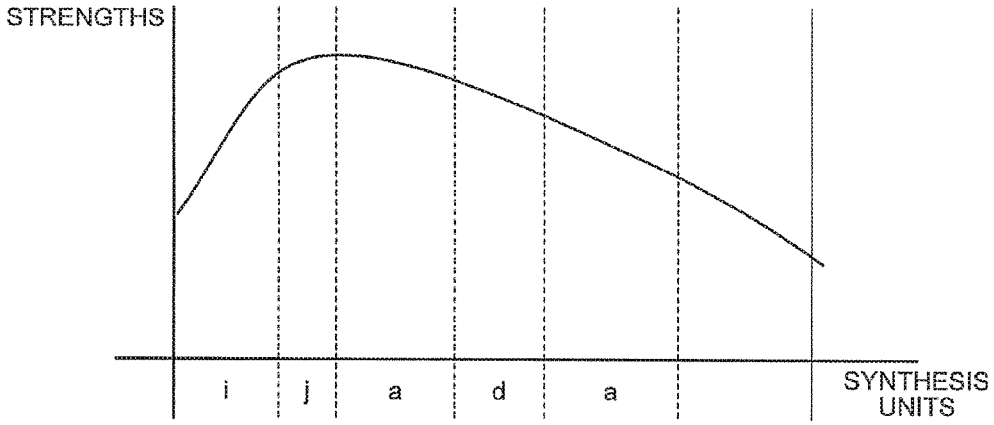
FIG. 8 is a diagram illustrating an exemplary series of phonetic parameters according to the embodiment.

For example, in the case of the normalized text 206, since the phonetic expression is /ijada:/ and the prosodic type is 2. Accordingly, the series of phonetic parameters of the normalized text 206 is as illustrated in FIG. 8. In the example of the series of phonetic parameters illustrated in FIG. 8, it is indicated that the speech waveforms corresponding to the synthesis units i, j, a, d, a, and : are arranged according to strengths represented by a curved line.

Meanwhile, there are times when the selector 24 selects, as the most plausible normalized text, a normalized text not registered in the language processing dictionary 25.

Figure 9:
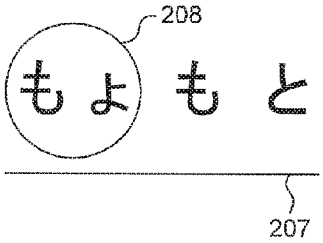
FIG. 9 is a diagram illustrating an exemplary normalized text that is not registered in a language processing dictionary according to the embodiment.
Figure 10:
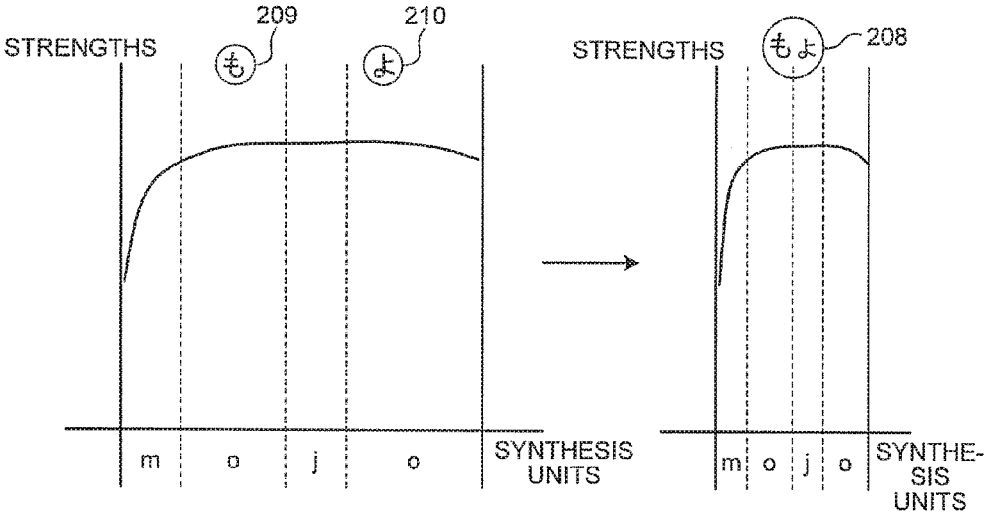
FIG. 10 is a diagram illustrating an example of phonetic parameters of peculiar expressions according to the embodiment.

FIG. 9 is a diagram illustrating an example of a normalized text 207 that is not registered in the language processing dictionary 25 according to the embodiment. In the case in which the selector 24 selects the normalized text 207 as the most plausible normalized text, there does not exist any information about the phonetic expression or the prosody because of the fact that the normalized text 207 is a word not registered in the language processing dictionary 25 (i.e., an unknown word). Moreover, an expression 208 cannot be typically pronounced. In such a case, for example, as illustrated in FIG. 10, the generator 31 generates a phonetic parameter in such a way that the synthesis unit of a normal expression 209 and the synthesis unit of a normal expression 210 are arranged at half of the normal time interval so that the sound is somewhere in between. Alternatively, the generator 31 can generate a phonetic parameter in a more direct manner so that a synthesized waveform is formed from the waveform of the normal expression 209 and the waveform of the normal expression 210.

As is the case of the expression 208, there are times when a normalization text includes an unknown word in lower case character. FIG. 11 is a diagram illustrating examples of lower-case characters as unknown words. Herein, regarding a lower-case character 109, a lower-case character 110, and a lower-case character 111; each can turn into an unknown word depending on the character with which it is combined. Moreover, since a lower-case character 112 is usually not a lower-case character, it is an unknown word at all times. When a normalized text includes a lower-case character as an unknown word, a phonetic parameter can be generated in which the phoneme immediately before the lower-case character is palatalized or labialized. Meanwhile, when lower-case characters that are unknown words are defined as peculiar expressions in the normalization rules, the modifier 33 (described later) modifies the phonetic parameters according to the expression styles.

To the modifier 33, the generator 31 outputs the series of phonetic parameters representing the phonetic sound of the normalized text, and outputs the expression styles at the positions in the selected normalized text that correspond to the peculiar expressions present in the input text Based on a phonetic parameter modification method according to the normalization rules of peculiar expressions, the modifier 33 modifies the phonetic parameters in the normalized text that correspond to the peculiar expressions in the input text. More particularly, based on the expression styles specified in the normalization rule, the modifier 33 modifies the phonetic parameters that represent the phonetic sound at the positions corresponding to the peculiar expressions in the input text. Herein, there can be a plurality of expression-style-based phonetic parameter modification methods.

FIG. 12 is a diagram illustrating exemplary phonetic parameter modification methods according to the embodiment. In the embodiment illustrated in FIG. 12, for each expression style, one or more expression-style-based phonetic parameter modification methods are set. For example, in order to achieve an expression style "to muddy the voice", it is indicated that the following cases are possible: a case in which the synthesis unit pronounced by straining the glottis is substituted; a case in which, even if the setting is to read out in a female voice, the synthesis unit of a male voice (a thick voice) is substituted; and a case in which the difference between the phonetic parameters of phonemes having distinction between voiced sound and unvoiced sound is applied the other way round.

Due to the phonetic parameter modification methods illustrated in FIG. 12, modification is done to the fundamental frequency, the length of each sound, the pitch of each sound, and the volume of each sound of the phonetic sound output by the output unit 35 (described later).

Meanwhile, if the text-to-speech device 10 constantly reflects the expression styles of peculiar expressions in the phonetic expression, then sometimes it becomes difficult to hear the phonetic sound. Hence, the configuration can be such that the expression styles set in advance to "reflection not required" by the user are not reflected in the phonetic parameters.

Meanwhile, if modification is done only to the phonetic parameters at the positions in the normalized text that correspond to the peculiar expressions present in the input text, then there is a possibility that the phonetic sound is unnatural. In that regard, the modifier 33 can be configured to modify the entire series of phonetic parameters representing the phonetic sound of the normalized text. In this case, there it may be necessary to perform a plurality of modifications to the same section of phonetic parameters. In that case, if a plurality of modification methods needs to be implemented, then it is desirable that the modifier 33 selects mutually non-conflicting modification methods.

For example, regarding a phonetic parameter modification method for reflecting the expression styles of peculiar expressions in the phonetic parameters; a case of applying "increase the qualifying age" and a case of applying "decrease the qualifying age" contradict with each other. In contrast, regarding a phonetic parameters modification method for reflecting the expression styles of peculiar expressions in the phonetic parameters; a case of applying "increase the qualifying age" and a case of applying "keep the volume high for a long duration of time" do not contradict with each other.

In case non-contradictory modification methods cannot be selected, the modifier 33 can determine the modification methods based on an order of priority set in advance by the user, or can select the modification methods in a random manner.

Returning to the explanation with reference to FIG. 1, the modifier 33 outputs, to the output unit 35, the series of phonetic parameters that are modified by referring to the modification rules 34. Then, the output unit 35 outputs the phonetic sound based on the series of phonetic parameters modified by the modifier 33.

The text-to-speech device 10 according to the embodiment has the configuration described above. With that, even if an input text contains peculiar expressions that are not used under normal circumstances, speech synthesis can be done in a flexible while having the understanding of the mood. That makes it possible to read out various input texts.

Explained below with reference to flowcharts is a text-to-speech method implemented in the text-to-speech device 10 according to the embodiment. Firstly, the explanation is given for the method by which the analyzer 20 determines a single normalized text corresponding to an input text containing peculiar expressions.

Figure 13:
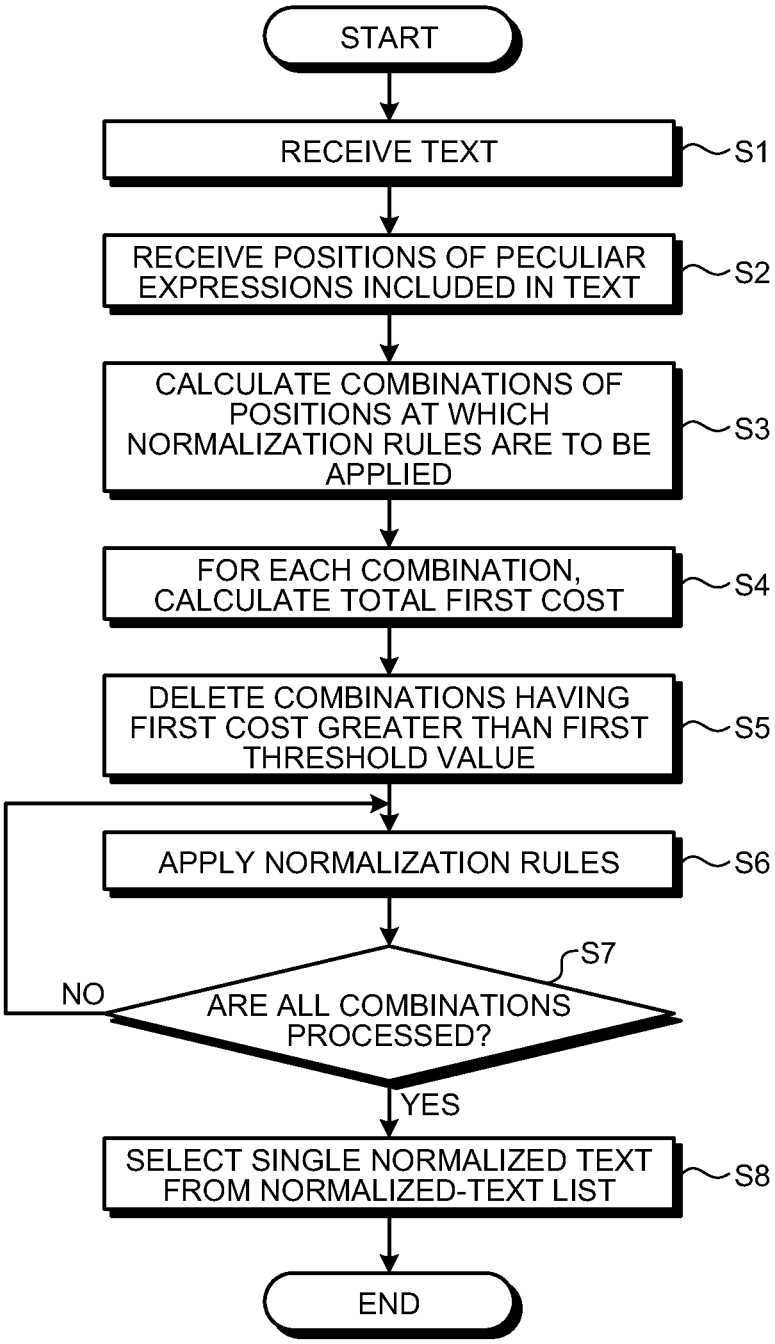
FIG. 13 is a flowchart illustrating an exemplary method for determining a normalizing text according to the embodiment.

FIG. 13 is a flowchart illustrating an example of the method for determining a normalizing text according to the embodiment. The receiver 21 receives input of a text containing peculiar expressions (Step S1), and outputs the input text to the normalizer 22. Then, the normalizer 22 identifies the positions of the peculiar expressions in the text (Step S2). More particularly, the normalizer 22 determines whether or not there are positions in the text which match with the peculiar expressions defined in the normalization rules, and identifies the positions of the peculiar expressions included in the text.

Subsequently, the normalizer 22 calculates combinations of the positions to which the normalization rules are to be applied (Step S3). Then, for each combination, the normalizer 22 calculates the total first cost in the case of applying the normalization rules (Step S4). Subsequently, the normalizer 22 deletes the combinations for which the total first cost is greater than a first threshold value (Step S5). As a result, it becomes possible to hold down the number of normalized texts that are generated, thereby enabling achieving reduction in the processing load of the selector 24 while determining a single normalized text.

Then, from among the combinations of positions in the text to which the normalization rules are to be applied, the normalizer 22 selects a single combination and applies the normalization rules at the corresponding positions in the text using the selected combination (Step S6). Subsequently, the normalizer 22 determines whether or not all combinations to which the normalization rules are to be applied are processed (Step S7). If all combinations are not yet processed (No at Step S7), then the system control returns to Step S6. When all combinations are processed (Yes at Step S7), the selector 24 selects a single normalized text from the normalized-text list that contains one or more normalized texts generated by the normalizer 22 (Step S8). More particularly, the selector 24 calculates the second costs mentioned above by performing language processing, and selects the normalized text having the smallest second cost.

Given below is the explanation of a method by which the synthesizer 30 modifies the phonetic parameters, which are determined from the phonetic expression of a normalized text, according to the expression styles of the peculiar expressions; and reads out the modified phonetic parameters.

Figure 14:
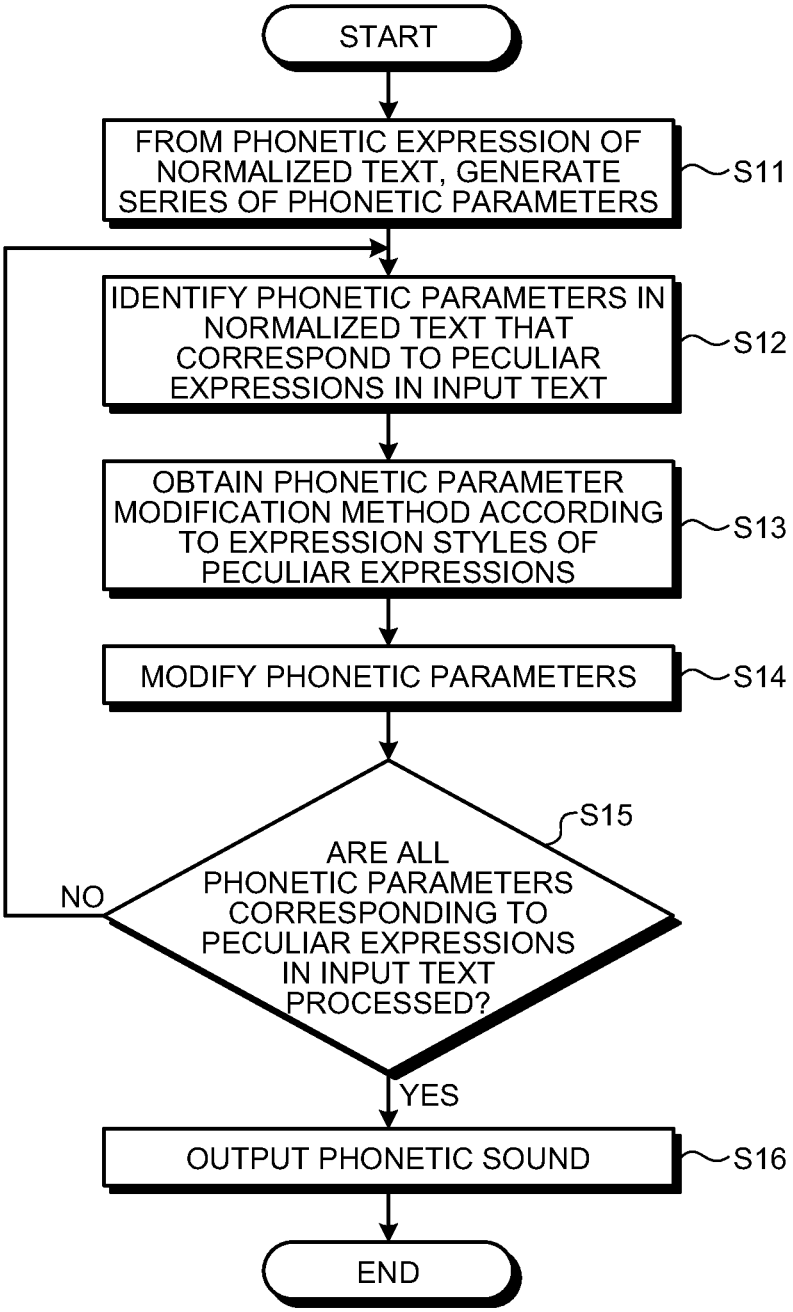
FIG. 14 is a flowchart for explaining an exemplary method for modifying phonetic parameters and reading out the modified phonetic parameters according to the embodiment.

FIG. 14 is a flowchart for explaining an example of the method for modifying the phonetic parameters and reading out the modified phonetic parameters according to the embodiment. The generator 31 makes use of the speech waveform generation data 32, and generates a series of phonetic parameters that represent the phonetic expression of the normalized text selected by the selector 24 (Step S11). Then, the modifier 33 identifies the phonetic parameters in the normalized text which correspond to the peculiar expressions included in the text that is input to the receiver 21 (Step S12).

Subsequently, the modifier 33 obtains the phonetic parameter modification method according to the expression styles of the peculiar parameters (Step S13).

Then, according to the modification method obtained at Step S13, the modifier 33 modifies the phonetic parameters identified at Step S12 (Step S14). Subsequently, the modifier 33 determines whether or not modification is done with respect to all phonetic parameters at the positions in the normalized text that correspond to the peculiar expressions included in the text that is input to the receiver 21 (Step S15). If all phonetic parameters are not yet modified (No at Step S15), then the system control returns to Step S12. When all parameters are modified (Yes at Step S15), the output unit 35 outputs the phonetic sound based on the series of phonetic parameters modified by the modifier 33 (Step S16).

Figure 15:
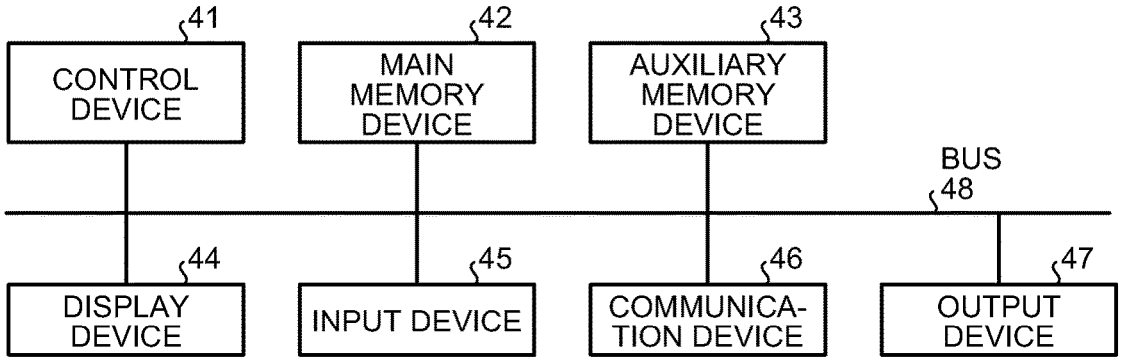
FIG. 15 is a diagram illustrating an exemplary hardware configuration of the text-to-speech device according to the embodiment.

Lastly, given below is the explanation about an exemplary hardware configuration of the text-to-speech device 10 according to the embodiment. FIG. 15 is a diagram illustrating an exemplary hardware configuration of the text-to-speech device 10 according to the embodiment. The text-to-speech device 10 according to the embodiment includes a control device 41, a main memory device 42, an auxiliary memory device 43, a display device 44, an input device 45, a communication device 46, and an output device 47. Moreover, the control device 41, the main memory device 42, the auxiliary memory device 43, the display device 44, the input device 45, the communication device 46, and the output device 47 are connected to each other by a bus 48. The text-to-speech device 10 can be an arbitrary device having the hardware configuration described herein. For example, the text-to-speech device 10 can be a personal computer (PC), or a tablet, or a smartphone.

The control device 41 executes computer programs that are read from the auxiliary memory device 43 and loaded into the main memory device 42. Herein, the main memory device 42 is a memory such as a read only memory (ROM) or a random access memory (RAM). The auxiliary memory device 43 is a hard disk drive (HDD) or a memory card. The display device 44 displays the status of the text-to-speech device 10. The input device 45 receives operation inputs from the user. The communication device 46 is an interface that enables the text-to-speech device 10 to communicate with other devices. The output device 47 is a device such as a speaker that outputs phonetic sound. Moreover, the output device 47 corresponds to the output unit 35 described above.

The computer programs executed in the text-to-speech device 10 according to the embodiment are recorded in the form of installable or executable files in a computer-readable recording medium such as a compact disk read only memory (CD-ROM), a memory card, a compact disk readable (CD-R), or a digital versatile disk (DVD); and are provided as a computer program product.

Alternatively, the computer programs executed in the text-to-speech device 10 according to the embodiment can be saved as downloadable files on a computer connected to the Internet or can be made available for distribution through a network such as the Internet.

Still alternatively, the computer programs executed in the text-to-speech device 10 according to the embodiment can be stored in advance in a ROM.

The computer programs executed in the text-to-speech device 10 according to the embodiment contain a module for each of the abovementioned functional blocks (i.e., the receiver 21, the normalizer 22, the selector 24, the generator 31, and the modifier 33). As the actual hardware, the control device 41 reads the computer programs from a memory medium and runs them such that the functional blocks are loaded in the main memory device 42. As a result, each of the abovementioned functional blocks is generated in the main memory device 42.

Meanwhile, some or all of the abovementioned constituent elements (the receiver 21, the normalizer 22, the selector 24, the generator 31, and the modifier 33) can be implemented using hardware, such as an integrated circuit, instead of using software.

As explained above, the text-to-speech device 10 according to the embodiment has normalization rules in which peculiar expressions, normal expressions of the peculiar expressions, and expression styles of the peculiar expressions are associated with one another. Based on the expression styles associated to the peculiar expressions in the normalization rules, modification is done to phonetic parameters that represent the phonetic expression at the positions in the normalized text that correspond to the peculiar expressions. As a result, even regarding a text in which the user has intentionally used peculiar expressions that are not used in normal expressions, the text-to-speech device according to the embodiment can perform appropriate phonetic expression while having the understanding of the user intentions.

Meanwhile, the text-to-speech device 10 according to the embodiment can be applied not only for reading out blogs or Twitter but also for reading out comics or light novels. Particularly, if the text-to-speech device 10 according to the embodiment is combined with the character recognition technology, then the text-to-speech device 10 can be applied for reading out the imitative sounds handwritten in the pictures of comics. Besides, if the normalization rules 23, the analyzer 20, and the synthesizer 30 are configured to deal with the English language and the Chinese language, then the text-to-speech device 10 according to the embodiment can be used for those languages too.

While a certain embodiment has been described, the embodiment has been presented by way of example only, and is not intended to limit the scope of the inventions. Indeed, the novel embodiment described herein may be embodied in a variety of other forms; furthermore, various omissions, substitutions and changes in the form of the embodiment described herein may be made without departing from the spirit of the inventions. The accompanying claims and their equivalents are intended to cover such forms or modifications as would fall within the scope and spirit of the inventions.

What is claimed is:

1. A text-to-speech system comprising a processing circuitry coupled to a memory, the processing circuit being configured to:

receive an input text which contains a peculiar expression representing an expression not used in normal expressions;

identify a position of the peculiar expression in the input text based on a normalization rule in which the peculiar expression, a normal expression for expressing the peculiar expression in a normal form, a non-linguistic expression style of the peculiar expression representing a manner in which the peculiar expression is read aloud, and a first cost are associated with one another, so as to generate one or more normalized texts;

calculate one or more combinations of one or more positions to which one or more normalization rules are to be applied;

calculate a total of the first cost or first costs in the case of applying the normalization rules for each combination of the combinations;

normalize the input text based on the normalization rules by using the combinations for which the total is smaller than a first threshold value;

perform language processing with respect to each of the normalized texts, and select a single normalized text based on result of the language processing;

generate a series of phonetic parameters representing phonetic expression of the single normalized text;

modify a phonetic parameter in the normalized text corresponding to the peculiar expression in the input text based on a phonetic parameter modification method according to the normalization rule of the peculiar expression; and output a phonetic sound which is synthesized using the series of phonetic parameters including the modified phonetic parameter.

2. The system according to claim 1, wherein the processing circuitry generates the series of phonetic parameters by selecting a synthesis unit from a synthesis unit dictionary, and the processing circuitry modifies the synthesis unit, which is selected by the processing circuitry, based on a phonetic parameter modification method according to the normalization rule of the peculiar expression.

3. The system according to claim 1, wherein the processing circuitry generates the series of phonetic parameters from an acoustic parameter based on a hidden Markov model, and the processing circuitry modifies the acoustic parameter, which is selected by the processing circuitry, based on a phonetic parameter modification method according to the normalization rule of the peculiar expression.

4. The system according to claim 1, wherein the processing circuitry modifies the phonetic parameter so as to change the fundamental frequency of the phonetic sound output by the processing circuitry.

5. The system according to claim 1, wherein the processing circuitry modifies the phonetic parameter so as to change length of each sound included in the phonetic sound output by the processing circuitry.

6. The system according to claim 1, wherein the processing circuitry modifies the phonetic parameter so as to change pitch of the phonetic sound output by the processing circuitry.

7. The system according to claim 1, wherein the processing circuitry modifies the phonetic parameter so as to change volume of the phonetic sound output by the processing circuitry.

8. A text-to-speech method comprising:

receiving an input text which contains a peculiar expression representing an expression not used in normal expressions;

identifying a position of the peculiar expression in the input text based on a normalization rule in which the peculiar expression, a normal expression for expressing the peculiar expression in a normal form, and a non-linguistic expression style of the peculiar expression representing a manner in which the peculiar expression is read aloud, and a first cost are associated with one another, so as to generate one or more normalized texts;

calculating one or more combinations of one or more positions to which one or more normalization rules are to be applied;

calculating a total of the first cost or first costs in the case of applying the normalization rules for each combination of the combinations;

normalizing the input text based on the normalization rules by using the combinations for which the total is smaller than a first threshold value;

performing language processing with respect to each of the normalized texts, and selecting a single normalized text based on result of the language processing;

generating a series of phonetic parameters representing phonetic expression of the single normalized text;

modifying a phonetic parameter in the normalized text corresponding to the peculiar expression in the input text based on a phonetic parameter modification method according to the normalization rule of the peculiar expression; and outputting a phonetic sound which is synthesized using the series of phonetic parameters including the modified phonetic parameter.

9. A computer program product comprising a non-transitory computer readable medium including programmed instructions, wherein the instructions, when executed by a computer, cause the computer to perform:

receiving an input text which contains a peculiar expression representing an expression not used in normal expressions;

identifying the position of the peculiar expression in the input text based on a normalization rule in which the peculiar expression, a normal expression for expressing the peculiar expression in a normal form, a non-linguistic expression style of the peculiar expression representing manner in which the peculiar expression is read aloud, and first cost are associated with one another, so as to generate one or more normalized texts;

calculating one or more combinations of one or more positions to which one or more normalization rules are to be applied;

calculating a total of the first cost or first costs in the case of applying the normalization rules for each combination of the combinations;

normalizing the input text based on the normalization rules by using the combinations for which the total is smaller than a first threshold value;

performing language processing with respect to each of the normalized texts, and selecting a single normalized text based on result of the language processing;

generating a series of phonetic parameters representing phonetic expression of the single normalized text;

modifying a phonetic parameter in the normalized text corresponding to the peculiar expression in the input text based on a phonetic parameter modification method according to the normalization rule of the peculiar expression; and outputting a phonetic sound which is synthesized using the series of phonetic parameters including the modified phonetic parameter.

* * * * *